US007238037B2

(12) United States Patent
Chen

(10) Patent No.: US 7,238,037 B2
(45) Date of Patent: Jul. 3, 2007

(54) ELECTRONIC MODULE WITH ELASTIC CONNECTOR

(75) Inventor: Yu-Lin Chen, Panchiao (TW)

(73) Assignee: Quanta Computer Inc., Tao Yuan Shien (TW)

( * ) Notice: Subject to any disclaimer, the term of this patent is extended or adjusted under 35 U.S.C. 154(b) by 0 days.

(21) Appl. No.: 11/391,355

(22) Filed: Mar. 29, 2006

(65) Prior Publication Data

US 2006/0183363 A1 Aug. 17, 2006

Related U.S. Application Data

(62) Division of application No. 10/915,469, filed on Aug. 11, 2004, now Pat. No. 7,056,135.

(30) Foreign Application Priority Data

Sep. 25, 2003 (TW) ..... 92217261 U

(51) Int. Cl.
*H01R 13/64* (2006.01)

(52) U.S. Cl. ..... 439/247

(58) Field of Classification Search ..... 439/247, 439/248, 313, 314, 351, 361, 131, 667; 174/48
See application file for complete search history.

(56) References Cited

U.S. PATENT DOCUMENTS

| | | | | |
|---|---|---|---|---|
| 4,293,174 | A * | 10/1981 | Knickerbocker | 439/246 |
| 4,886,472 | A * | 12/1989 | Tsai | 439/656 |
| 4,970,460 | A * | 11/1990 | Jensen et al. | 324/754 |
| 5,670,847 | A * | 9/1997 | Lin | 315/185 S |
| 6,478,587 | B2 * | 11/2002 | Sharples | 439/131 |
| 6,485,322 | B1 * | 11/2002 | Branch et al. | 439/357 |
| 6,780,049 | B1 * | 8/2004 | D'Angelo et al. | 439/537 |
| 7,056,135 | B2 * | 6/2006 | Chen | 439/247 |
| 2006/0046796 | A1 * | 3/2006 | Park et al. | 455/575.4 |

* cited by examiner

*Primary Examiner*—Chandrika Prasad
(74) *Attorney, Agent, or Firm*—Rabin & Berdo, P.C.

(57) ABSTRACT

An elastic computer connector is described. The elastic computer connector utilizes an elastic device to couple the elastic computer connector to a corresponding computer connector with a predetermined contact force so as to eliminate a poor contact problem. The elastic computer connector includes a protection shell, contact terminals, a wire set, and at least one elastic device. The protection shell protects the contact terminals and the contact terminals are coupled to the corresponding computer connector. The elastic device provides a spring force while the elastic computer connector is coupled to the corresponding computer connector to maintain the predetermined contact force.

9 Claims, 2 Drawing Sheets

ELECTRONIC MODULE WITH ELASTIC CONNECTOR

This is a Divisional of U.S. application Ser. No.: 10/915,469, filed Aug. 11, 2004, now U.S. Pat. No. 7,056,135.

BACKGROUND

1. Field of the Invention

The present invention relates to an elastic computer connector, and more particularly, to a Serial AT Attachment (SATA) elastic computer connector.

2. Description of Related Art

Due to an enormous increase of computer processing speed, the computer can handle a significant amount of data and information. For storing data and information, hard disks play an important role for computers. Normally, in a computer system, the hard disk is the main storage medium for storing programs, files, and various data and information. The speed and volume of the hard disk are important factors in determining the performance of the hard disk.

With increases in hard disk volume by magnetic head technology and magnetic disc structure improvements, the external transmission interface specification has to be improved to provide enough bandwidth for input and output. To meet this need, the AT Attachment (ATA) transmission interference has been developed. The ATA transmission interface has progressively evolved from the Ultra ATA to the Ultra ATA/66, then to the Ultra ATA/100, and most recently to the Ultra ATA/133.

However, the Ultra ATA/133 faces a bottleneck in transmission speed, and the Ultra ATA/133 cannot fulfill the transmission requirement between the latest computers and the hard disks. A Serial ATA has accordingly been developed to replace the Ultra ATA/133 to be a new standard for the computer storage medium interface.

A Serial ATA is a new ATA interface standard specification for multipurpose usage, high-speed transmissions, friendly interfacing and compatibility with Parallel ATA software to extend the application of the SATA specification.

The transmission speed of the SATA ranges from 150 MB for the first generation product to 600 MB for the third generation product. The SATA can save the interior space of a computer because the SATA requires a thinner flat ribbon cable than other ATA standards, allowing the cables to be curved arbitrarily. Therefore, the SATA can effectively help to shrink the computer shell. In addition, the SATA provides a hot plug function for quickly connecting a peripheral device to the computer.

SATA uses thinner and more flexible wires to connect the hard disk to the computer with less quantity of contact terminals and smaller connectors. Therefore, the SATA connector is thinner, lighter, and shorter, and a power design thereof is also safer. The hard disk fulfilling the SATA standard requirement can be accessed immediately after being connected to the computer because it supports the hot plug function. Accordingly, the SATA hard disk is more popular to the public, and therefore hot plug hard disks have claimed widespread use.

However, the SATA connector's small physical size poses some problems. Due to both poor strength and manufacturing tolerances, contact between the SATA connectors is often poor. In addition, while the SATA hard disk is under vibration, signal loss occurs between the computer and the hard disk.

SUMMARY

It is an objective of the present invention to provide an elastic computer connector to eliminate poor contact of computer connectors to enhance transmission efficiencies of the computer connectors.

It is another objective of the present invention to provide an elastic computer connector to keep a predetermined contact force between the coupled computer connectors so as to transmit data and power stably.

To accomplish the above objectives, the present invention provides an elastic computer connector which utilizes an elastic device to keep a predetermined contact force between the elastic computer connector and a corresponding connector of a peripheral device coupled to the elastic computer connector. The elastic computer connector includes a protection shell, contact terminals, a wire set, and at least one elastic device. The protection shell protects the contact terminals and the contact terminals are utilized to couple electrically to the corresponding connector of the peripheral device. One end of the wire set is coupled to the contact terminals and another end of the wire set is coupled to a host computer. The elastic device is configured in the protection shell. When the elastic computer connector is coupled to the corresponding connector of the peripheral device, the elastic device generates an elastic deformation to maintain the predetermined contact force between the elastic computer connector and the corresponding connector.

The elastic device further includes a stop block, a spring, and a sliding seat. The spring provides the elastic deformation for the elastic device and maintains the predetermined contact force between the elastic computer connector and the corresponding connector. The sliding seat glidingly holds the stop block and therefore the stop block can slide therein.

The sliding seat further includes a stop flange to stop the stop block so as to generate an insertion force for the elastic computer connector and the corresponding connector. The protection shell further includes an upper cover and a lower cover, and each has an opening. At least one fixing device is utilized to go through the openings of the upper cover and the lower cover and couple to the stop block for deforming the spring.

The wire set has a power wire for supplying power and a signal wire for transmitting signals. The contact terminals fulfill a Serial ATA standard specification.

Another aspect of the present invention is to provide a removable module having a removable peripheral device, a fixing device, an elastic computer connector, and a sliding compartment constructed by a removable module sidewall, a removable module sliding track, and a removable module base. The fixing device glidingly couples the elastic computer connector to the removable module base. When the removable peripheral device is inserted into the sliding compartment and the corresponding connector of the removable peripheral device is therefore coupled to the elastic computer connector, the fixing device pushes the elastic device to generate an elastic deformation to maintain a predetermined contact force between the elastic computer connector and the corresponding connector.

The removable peripheral device is a Serial ATA hard disk and/or a Serial ATA optical drive.

The removable module and the elastic computer connector according to the present invention utilize the spring force of the elastic device to keep a predetermined contact force between the connectors when the removable peripheral device is inserted into the removable module so that the signal breaks caused by vibrations and poor contact problem of the coupled connectors can be eliminated. Therefore, the transmission efficiency of the SATA connectors can be enhanced so that the transmission speed of the SATA connectors can be effectively increased.

BRIEF DESCRIPTION OF THE DRAWINGS

The foregoing aspects and many of the attendant advantages of this invention are more readily appreciated as the same becomes better understood by reference to the following detailed description, when taken in conjunction with the accompanying drawings, wherein.

DESCRIPTION OF THE PREFERRED EMBODIMENTS

The following description is of the best presently contemplated mode of carrying out the present invention. This description is not to be taken in a limiting sense but is made merely for the purpose of describing the general principles of the invention. The scope of the invention should be determined by referencing the appended claims.

Figure 1:
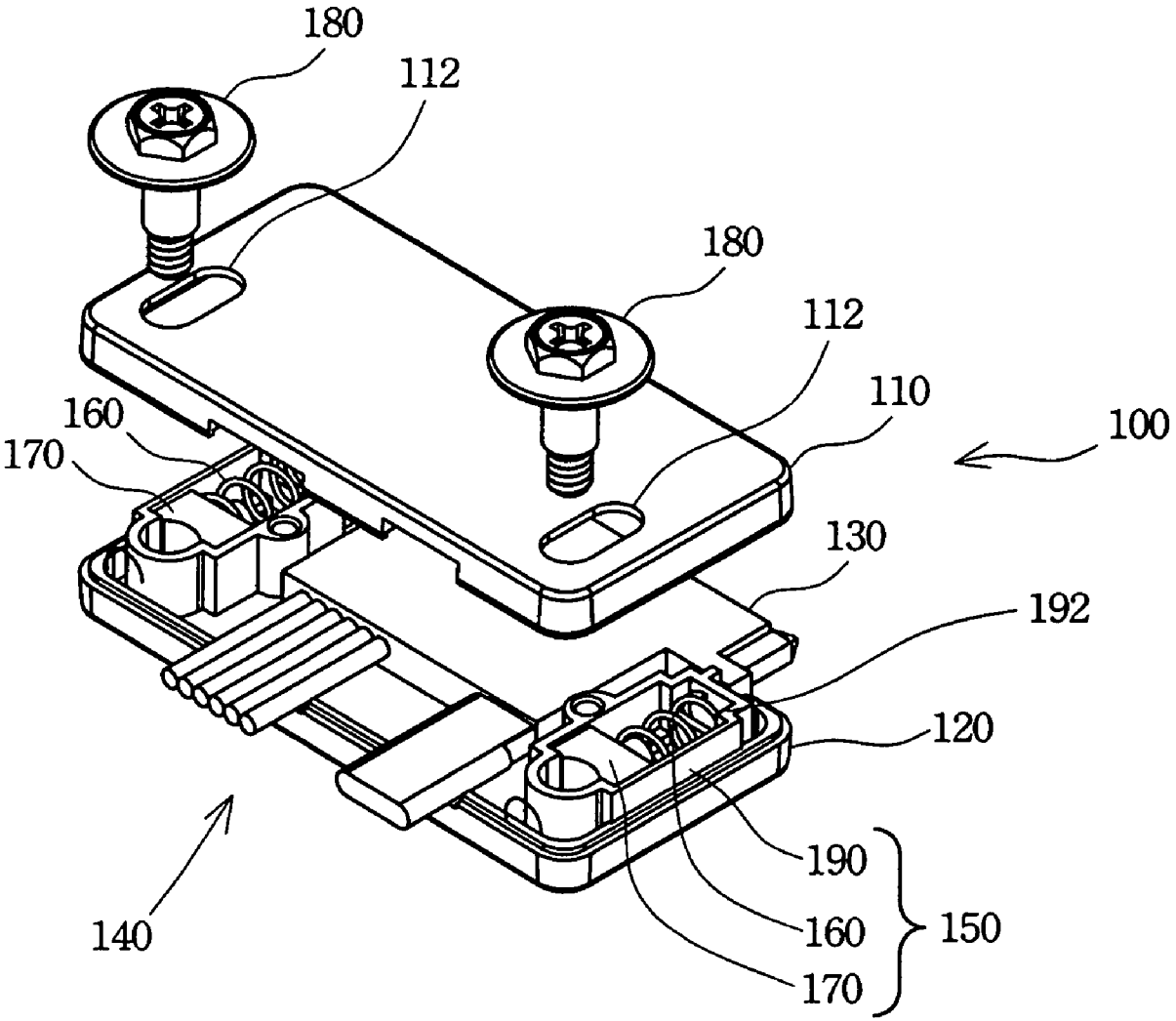
FIG. 1 is a preferred embodiment of an elastic computer connector according to the present invention.

FIG. 1 is a preferred embodiment of an elastic computer connector according to the present invention. The elastic computer connector 100 has an upper cover 110, a lower cover 120, SATA contact terminals 130, and a wire set 140, and an elastic device 150. One end of the wire set 140 is utilized to connect to a host computer and includes signal wires and power wires. Another end of the wire set 140 is coupled to the SATA contact terminals 130. The SATA contact terminals 130 couple to a corresponding SATA connector of a hard disk to read and write data therein. The upper cover 110 and the lower cover 120 construct a protection shell to protect the SATA contact terminals 130 and further increase the strength and rigidity of the elastic computer connector 100.

The elastic computer connector 100 is glidingly coupled to the fixing device 180 passing through an opening 112 on the upper cover 110 and the lower cover 120 of the elastic computer connector 100 so that the elastic computer connector 100 is able to slide along the fixing device 180. The elastic device 150 provides resilient force for moving the elastic computer connector 100.

In the preferred embodiment, the elastic device 150 has a spring 160, a stop block 170, and a sliding seat 190. When a corresponding SATA connector of a hard disk is coupled to the elastic computer connector 100, the corresponding SATA connector is pushed to connect with the elastic computer connector 100 so that the stop block 170 of the elastic device 150 is pushed toward the spring 160 caused by a reacting force on the fixing device 180. The spring 160 is therefore deformed and provides an insertion force for the elastic computer connector 100 and the corresponding SATA connector. Furthermore, the insertion force is enhanced while the stop block 170 touches a stop flange 192 of a sliding seat 190. Therefore, the elastic computer connector 100 can effectively be inserted into the corresponding SATA connector.

In the meantime, the elastic computer connector 100 keeps a predetermined contact force on the corresponding SATA connector of the hard disk because the spring 160 of the elastic device 150 is still under a compressive state. The predetermined contact force can push the connectors closer together. Hence, the elastic computer connector 100 according to the present invention can effectively eliminate the poor contact problem, even under a hot plug operation. Furthermore, when the hard disk in under a vibration force, the elastic computer connector 100 can effectively avoid signal breaks and lost.

Figure 2:
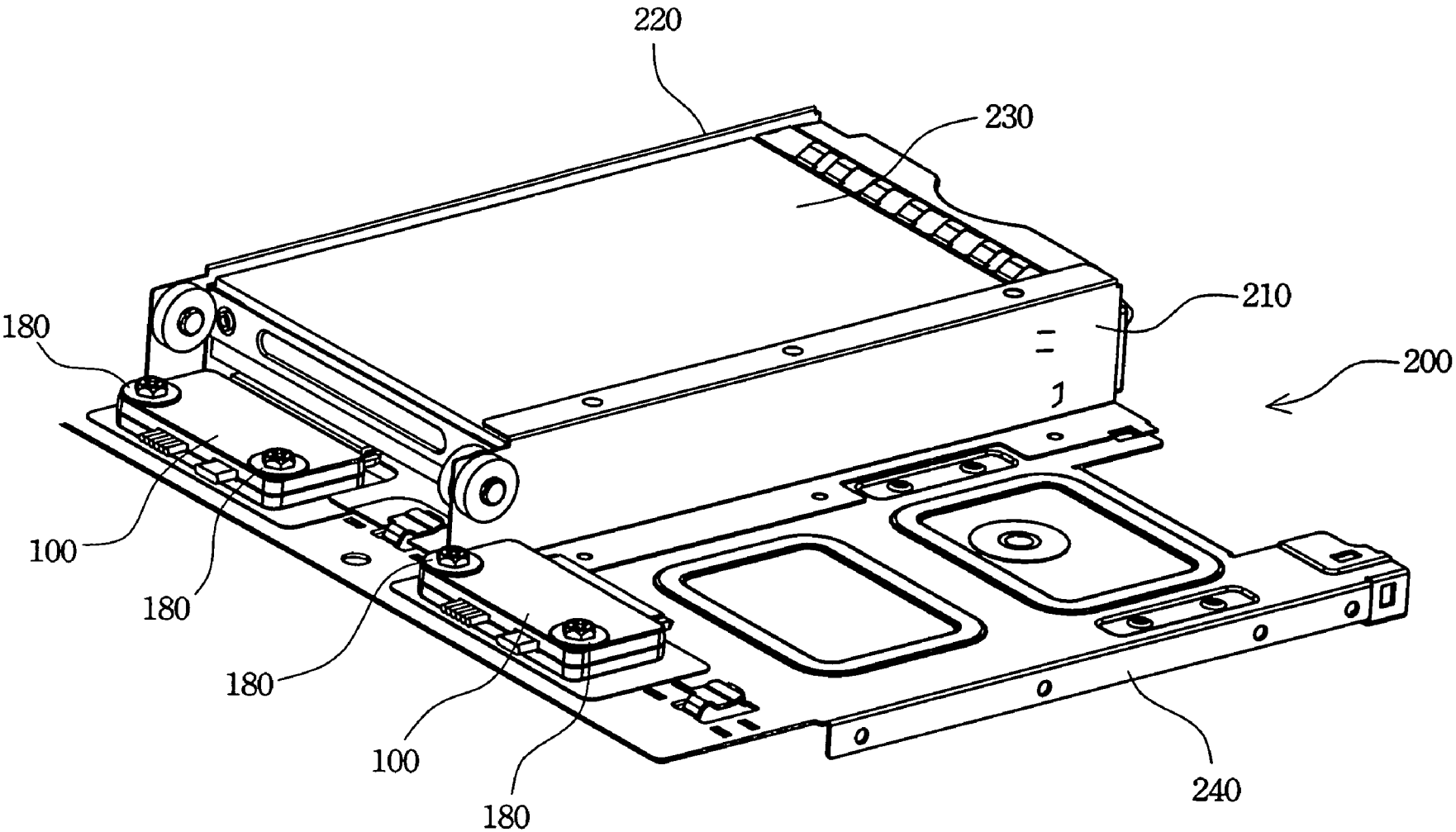
FIG. 2 illustrates a schematic view of the preferred embodiment of FIG. 1 applied to a removable module.

FIG. 2 illustrates a schematic view of the preferred embodiment of FIG. 1 applied to a removable module. The removable module 200 has a removable module sliding track 210, a removable module sidewall 220, and a removable module base 240 to construct a sliding compartment for storing a removable storage medium 230. An end portion of the removable module 200 includes an elastic computer connector 100, and the fixing devices 180 are utilized to couple the elastic computer connector 100 glidingly to the removable module base 240. When the removable storage medium 230 is inserted into the sliding compartment of the removable module 200, the removable storage medium 230 is moved toward the elastic computer connector 100 along the removable module sliding track 210 and the removable module sidewall 220. When the removable storage medium 230 is fixed in the removable module 200, and the corresponding SATA connector of the removable storage medium 230 is coupled glidingly to the elastic computer connector 100, the elastic computer connector 100 and the corresponding SATA connector of the removable storage medium 230 can keep a predetermined contact force due to the functionality of the elastic device 150 so as to contact more closely. Therefore, the elastic computer connector 100 according to the present invention can effectively improve the signal transmission efficiency between the computer and the removable storage medium 230, and further avoid the poor contact or the signal break caused by vibrations.

The removable storage medium 230 can be any storage device with the SATA connector, for example, a hard disk, an optical drive, or the like. Furthermore, the elastic device according to the present invention can be applied to any similar connector to maintain an adequate force to enhance the connector transmission efficiency.

As is understood by a person skilled in the art, the foregoing preferred embodiments of the present invention are illustrative of the present invention rather than limiting of the present invention. It is intended that various modifications and similar arrangements be included within the spirit and scope of the appended claims, the scope of which should be accorded the broadest interpretation so as to encompass all such modifications and similar structures.

What is claimed is:

1. A removable module, comprising:

a removable module sidewall;

a removable module sliding track connecting to the removable module sidewall;

a removable module base, the removable module sidewall set on the removable module base;

a removable peripheral device, wherein the removable module sidewall, the removable module sliding track, and the removable module base construct a sliding compartment for storing and sliding the removable peripheral device;

at least one fixing device; and an elastic computer connector further comprising:

a protection shell, wherein the fixing device glidingly couples the protection shell to the removable module base;

contact terminals configured in the protection shell to connect with a corresponding connector of the removable peripheral device;

a wire set, one end of the wire set coupling to the contact terminals and another end of the wire set coupling to a host computer; and at least one elastic device configured in the protection shell and coupling to the fixing device, wherein when the removable peripheral device is inserted into the sliding compartment and the corresponding connector of the removable peripheral device is coupled to the elastic computer connector, the fixing device pushes the elastic device to generate an elastic deformation to maintain a predetermined contact force between the elastic computer connector and the corresponding connector.

2. The removable module of claim 1, wherein the elastic device further comprises:

a stop block;

a spring coupling to the stop block to provide the elastic deformation for the elastic device and maintain the predetermined contact force between the elastic computer connector and the corresponding connector; and a sliding seat configured in the protection shell to hold the stop block for sliding therein.

3. The removable module of claim 2, wherein the sliding seat further comprises a stop flange to stop the stop block and provide an insertion force for the elastic computer connector and the corresponding connector.

4. The removable module of claim 2, wherein the protection shell further comprises:

an upper cover having at least an upper opening; and a lower cover having at least lower opening, wherein the fixing device goes through the upper opening of the upper cover and the lower opening of the lower cover, and couples to the stop block.

5. The removable module of claim 1, wherein the wire set comprises a power wire and a signal wire.

6. The removable module of claim 1, wherein the contact terminals fulfill a Serial ATA standard specification.

7. The removable module of claim 1, wherein the removable peripheral device comprises a removable storage medium.

8. The removable module of claim 7, wherein the removable storage medium is a Serial ATA hard disk.

9. The removable module of claim 7, wherein the removable storage medium is a Serial ATA optical drive.

* * * * *